US007004084B1

(12) United States Patent
Anderson et al.

(10) Patent No.: US 7,004,084 B1
(45) Date of Patent: Feb. 28, 2006

(54) CORN BURNER

(76) Inventors: C. Merton Anderson, Box 2075, Mankato, Blue Earth, MN (US) 56002; Charles Lynn Anderson, 19995 State Hiwy 22, Mankato, Blue Earth, MN (US) 56001

( * ) Notice: Subject to any disclaimer, the term of this patent is extended or adjusted under 35 U.S.C. 154(b) by 290 days.

(21) Appl. No.: 10/636,291

(22) Filed: Aug. 5, 2003

Related U.S. Application Data

(60) Provisional application No. 60/401,281, filed on Aug. 5, 2002.

(51) Int. Cl.
*F23G 5/00* (2006.01)
*F23G 5/44* (2006.01)
*F23N 5/18* (2006.01)

(52) U.S. Cl. ..... 110/186; 110/188; 110/229; 110/255

(58) Field of Classification Search ..... 110/185, 110/186, 187, 188, 189, 190, 229, 246, 299, 110/255, 257, 101 R, 101 C, 110; 219/476, 219/480, 510
See application file for complete search history.

(56) References Cited

U.S. PATENT DOCUMENTS

| | | | | |
|---|---|---|---|---|
| 21,445 A | | 9/1858 | Savage | |
| 35,632 A | | 6/1862 | Sexton | |
| 205,428 A | | 6/1878 | Schultz | |
| 373,846 A | | 11/1887 | Oldershaw | |
| 535,413 A | | 3/1895 | Richards | |
| 675,147 A | | 5/1901 | Bemelmans | |
| 737,306 A | | 8/1903 | Wilson | |
| 1,371,390 A | | 3/1921 | Olds | |
| 1,757,051 A | | 5/1930 | Klopfer | |
| 2,054,805 A | | 9/1936 | Burton | |
| 2,141,764 A | | 12/1938 | Riddell | |
| 2,303,135 A | * | 11/1942 | Olsen | 236/1 F |
| 2,619,952 A | | 12/1952 | Hardy et al. | |
| 3,930,490 A | | 1/1976 | Lassy et al. | |
| 4,228,747 A | | 10/1980 | Smirlock et al. | |
| 4,311,102 A | | 1/1982 | Kolze et al. | |
| 4,438,756 A | | 3/1984 | Chamberlain et al. | |
| 4,565,184 A | | 1/1986 | Collins et al. | |
| 4,613,302 A | | 9/1986 | Oliver | |
| 4,619,209 A | | 10/1986 | Traeger et al. | |
| 4,669,396 A | | 6/1987 | Resh | |
| 4,842,190 A | * | 6/1989 | Orchard | 236/11 |
| 4,856,438 A | | 8/1989 | Peugh | |
| 4,947,769 A | | 8/1990 | Whitfield | |
| 5,000,100 A | | 3/1991 | Mendive et al. | |
| 5,001,993 A | | 3/1991 | Gramlow | |
| 5,010,831 A | | 4/1991 | Halfhide | |
| 5,123,360 A | | 6/1992 | Burke et al. | |

(Continued)

*Primary Examiner*—Kenneth Rinehart
(74) *Attorney, Agent, or Firm*—Albert W. Watkins

(57) ABSTRACT

A corn-burning stove provides cooling for the corn in-feed auger and other adjacent components by combustion inlet air flow patterns. The inlet air flow transports pellet fuel through a distance within the fire pot which varies responsive to the flow rate of the inlet air flow. A fire pot and agitator ensure, in combination with the inlet air flow, complete burning of the corn, with almost no ash production and while avoiding the formation of clinkers. The agitator is toothed, having teeth closely adjacent the burn pot for moving burning corn kernels or solid pellets across the fire pot. Retractable ignitors have handles and furnace function interlocks. A process control is associated with the corn burner that includes some logic, including interlock, power control, speed controls, sensing inputs/devices, and user interface.

15 Claims, 7 Drawing Sheets

U.S. PATENT DOCUMENTS 5,129,033 A * 7/1992 Ferrara et al. ..... 392/447
5,263,642 A 11/1993 Orchard
5,873,356 A 2/1999 Vossler et al.
6,289,266 B1 9/2001 Payson et al.
6,464,430 B1 * 10/2002 Maleck ..... 405/128.6
2002/0083944 A1 7/2002 Darbonne, Sr.

* cited by examiner

CORN BURNER

CROSS REFERENCE TO RELATED APPLICATIONS

This application claims priority to U.S. provisional patent application Ser. No. 60/401,281 filed Aug. 5, 2002.

BACKGROUND OF THE INVENTION

1. Field of the Invention

This invention pertains generally to furnaces, and more particularly to furnaces that incorporate screw-type fuel feeders. In a particular manifestation of the invention, corn kernels are used as a fuel source.

2. Description of the Related Art

Thermal energy has many fundamental applications, ranging from basic necessities such as adequate warmth within a shelter to comfort and pleasantries such as hot water used in baths, spas and swimming pools. Representative of the breadth of applications are the diverse apparatus that have been devised to provide desired thermal energy. Common modern sources of thermal energy include electricity such as is typically produced at large electrical generation power plants, propane, kerosene, fuel oil, other petroleum-derived compounds, coal, natural gas, and wood. More recently, various easily renewable materials have been pursued which might provide the necessary fuel source for production of thermal energy. Among the fuel sources considered, which are too great to individually list herein, are biomass pellets which may be manufactured from diverse organic-based sources such as plant materials and crop residues. Corn, which is available naturally as kernels, has presented another opportunity for a readily renewable resource.

In spite of ready availability, and often times extremely competitive pricing per unit of energy produced, the use of corn as a fuel source has presented several challenges. One such challenge is the delivery of the corn kernels to the combustion chamber, hereinafter referred to as the fire pot. Unlike prior art liquid fuels, which may be delivered absent air or oxygen, corn kernels will, if not further processed, present small spaces and gaps between kernels which in turn entrap air. As some prior art burners have demonstrated, the temperature within a fire pot is sufficient to heat and ultimately ignite kernels within an auger feeder, owing to the availability of the air therein. One approach has been to vent air directly through the fuel source, in this case corn kernels, and into the fire pot. Exemplary of such air flow through the auger tube is illustrated in U.S. Pat. Nos. 4,619,209 to Traeger et al and 5,123,360 to Burke et al, the contents which are incorporated herein by reference. By such technique, the kernels will desirably be cooled sufficiently to prevent the back-spreading of fire into the hopper area of the furnace. Unfortunately, it is not always possible to control how tightly the kernels may be packed within the auger. Consequently, it is also not possible to reliably control the flow of air there through, nor to predict the temperature therein.

Another limitation of pellet furnaces in general, and also corn burners, is the difficulty with initial ignition and start-up of the furnace. Solid pellets or kernels are not readily mixed within an air stream, and so consequently cannot simply be sprayed and ignited with a spark or the like. Instead, the solid fuel is more commonly decomposed within a very hot fire pot, and the resultant gases combusted to produce the desired thermal energy. In order to obtain this sequence, the fire pot must be at a sufficiently elevated temperature to enable thermal decomposition. One method of obtaining this temperature is to use an electric heater, referred to commonly as an ignitor, to heat a location within the fire pot to the substantial temperature required for proper combustion. Once the localized region heats and ignites, the energy released therefrom will similarly be useful to support combustion across an even larger area within the fire pot. Eventually, it is desirable to have as large a region within the fire pot heated as possible, though using the prior art burners this has not been practical. In some prior art designs, ignitors have remained within the fire pot for the entire operation of the furnace. Unfortunately, this exposes the ignitor to continuously elevated temperatures, which tends to degrade the ignitor unnecessarily. Furthermore, the physical placement of the ignitor, which is usually selected to be in as close a proximity to the solid fuel as is reasonably practical, will interference once the combustion process has actually begun and attained a self-supporting status. Commensurate therewith, there have been a few designs in the prior art that have provided for the removal of these ignitors once combustion has become self-sustaining with the fuel pellets. Nevertheless, the control of these ignitors has heretofore required expensive equipment which has been of little use or benefit other than for the few seconds of use inserting or removing the ignitor. Owing to the time lag typical with the proper ignition of these types of furnaces, they may be ignited only once or a few times during an entire heating season. Consequently, the additional hardware and mechanics that add cost are most undesired. Exemplary prior art ignitors are illustrated by U.S. Pat. Nos. 5,000,100 to Mendive et al and 5,263,642 to Orchard, the contents which are incorporated herein by reference in entirety.

Another challenge of corn burners is the requirement for proper temperature, mixing and oxygen exposure. If a mass of corn is left relatively undisturbed during the burning process, there is a great likelihood that a clinker will form. Clinkers are large, very hard clumps of spent fuel. Unfortunately, owing to the hardness and solid mass formed, a clinker will not typically further burn, and it will instead interfere with the combustion of other kernels. Finally, the presence of these clinkers represents a waste product which is undesirable, and will require further disposal. No effective solution has been provided heretofore, though U.S. Pat. No. 4,947,769 to Whitfield, the contents which are incorporated herein by reference, illustrates a rotating member to remove ash and clinkers from the combustion grate.

Yet another challenge of the prior art pellet and corn burners is that of maintaining optimum temperature control. In liquid-fueled furnaces, the furnace will generally be sized to have excess heat capacity, where the time on and off is used to determine the actual heat output. Since the flame is formed through the simple generation of a spark, starting and stopping the heating cycle is very simple. The building or space being heated is used as a thermal mass which evens out the temperature between operating cycles of the furnace. While this has in the past been associated with draftiness and lack of comfort, the approach is nevertheless made possible by the easy ignition of the fuel source. In contrast, and as aforementioned with respect to the ignitors, the starting cycle for a corn fueled furnace may be measured by many minutes or hours. Furthermore, the start-up of a corn burner is less precise and may require user intervention. Both the time and intervention required will interfere with or prevent the cycling found in liquid or gas furnaces. Instead, the furnace will preferably stay lit and will use other technique for controlling heat output. In the past, this control has either been absent, meaning the furnace has been simply run at full capacity non-stop, or there has been only limited control provided. In practice, a user has been required to select a proposed heat output for the day, based upon anticipated heating needs. For a closed building of large thermal mass, this technique can provide the necessary level of control. However, when a larger door, such as an overhead door commonplace in factory loading docks and where large machinery is stored and removed for use, there may be substantial heat loss in short time periods. The present thermal regulation of corn burners is inadequate to compensate for these short period loads. Some furnaces which attempt to include speed control are illustrated by U.S. Pat. Nos. 5,873,356 to Vossler et al and 4,856,438 to Peugh, the contents of each which are incorporated herein by reference for their teachings with regard to control systems.

SUMMARY OF THE INVENTION

In a first manifestation, the invention is a pellet fuel burner operative to combust pellet fuel and thereby produce thermal energy. A fire pot is operative to contain pellet fuel during combustion. A fuel auger introduces pellet fuel into the fire pot, and a variable gas stream is coupled to the fuel auger. The variable gas stream receives the pellet fuel and transports it across the fire pot by an amount which varies responsive to a variance within the variable gas stream.

In a second manifestation, the invention is a solid fuel burner having variable energy output responsive to a variable demand. The burner has a combustion chamber, a means for supplying oxygen to the combustion chamber, and a means for introducing solid fuel into the combustion chamber. A means is provided for variably controlling at least one of the oxygen supply means and solid fuel introducing means. A means detects a threshold magnitude of variable demand, and a means responsive to threshold magnitude detection causes the variable control means to vary at least one of the oxygen supply means and solid fuel means.

In a third manifestation, the invention is an agitated solid fuel burner. A combustion chamber has a trough shaped fire pot and a solid fuel inlet. An agitator extends longitudinally within the combustion chamber and rotates thereabout. The agitator has a plurality of teeth extending from a central agitator axis. A drive operatively rotates the agitator relative to the fire pot.

In a fourth manifestation, the invention is, in combination, a fire pot, fuel pellets and an ignitor which produces temperatures sufficient for ignition. The improvement comprises a means to manually position the ignitor between a first position operative to ignite fuel pellets and a second position removed from interference with combustion.

OBJECTS OF THE INVENTION

Exemplary embodiments of the present invention solve inadequacies, of the prior art by providing a corn burner having a cooled auger, retractable ignitors, a helically toothed agitator, and heat demand anticipation.

A first object of the invention is to provide thermal energy through the combustion of corn kernels or like fuels. A second object of the invention is to convert a pellet fuel efficiently. Another object of the present invention is to generate a minimum amount of ash and prevent the formation of clinkers. A further object of the invention is to anticipate thermal demand, and adjust thermal output appropriately. Yet another object of the present invention is to distribute combustible fuel throughout a combustion chamber, whereby the total capacity of the furnace for a given volume is maximized.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 5*a* illustrates a first preferred embodiment concentric arrangement of auger and auger interior tube with respect to auger exterior tube, while

DESCRIPTION OF THE PREFERRED EMBODIMENT

Figure 1:
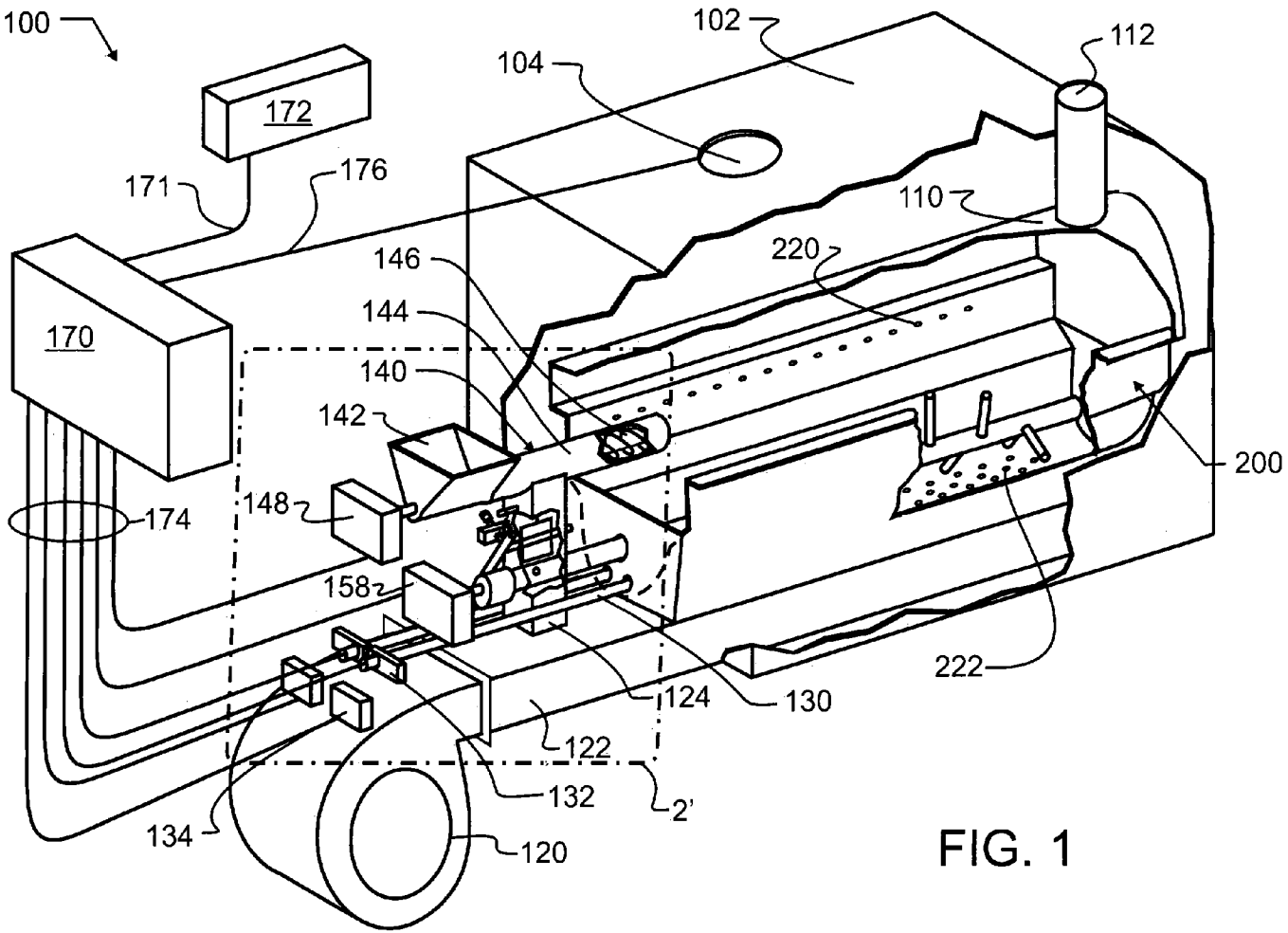
FIG. 1 illustrates a preferred embodiment corn furnace designed in accord with the teachings of the invention from projected view, with some of the components shown by partial cut-away and by schematic block diagram, the selection of block or cut-away made where appropriate to best illustrate the internal workings of the preferred embodiment.

A most preferred embodiment corn burner 100 designed in accord with the teachings of the present invention is illustrated in FIG. 1. A fire chamber wall formed by cover 110 and fire pot 200 isolates combustion gases from an exterior thereof, while providing a compartment within which safe and controlled burning may occur. Passing through the fire chamber wall is an exhaust 112, which most preferably encloses and directs combustion gases to a safe exterior vent. The overall efficiency of corn burner 100 may be improved from the schematic illustration of FIG. 1 if, for example, the exhaust is brought through the interior of furnace exterior wall 102, such as, for example, by adding two right angle bends therein which would run exhaust 112 parallel to fire pot 200. This provides more surface area for heat to be exchanged through from an exhaust gas stream and the room air being heated.

Auger 140, through outer auger tube 144, also passes through the fire chamber wall. Auger 140 provides a controlled feed of combustible fuel into fire pot 200. Agitator 150 similarly passes through the fire chamber wall. Agitator 150 ensures a gentle stirring of fuel within fire pot 200, thereby ensuring complete combustion of fuel. Ignitor elements 130, only one of which is numbered in the figures, similarly passes through the fire chamber wall. At least one ignitor element is most preferably provided to initiate combustion when corn burner 100 is first started. Several sources of inlet air which bring necessary oxygen to the fuel for combustion to occur are also provided which pass through the fire chamber wall. In addition to the fire chamber and contents therein, a blower 120 is provided to circulate inlet air. Through ducts which will be discussed in more detail herein below, inlet air 120 is most preferably pre-heated during circulation, serving as cooling air for critical components. A hopper 142 serves as a container bin for solid fuel, which in the preferred embodiment is most preferably corn. Hopper 142 may be a relatively small hopper directly attached to the furnace, or may be a separate, more remotely located and much larger hopper which uses an auger to not only feed fuel into fire pot 200, but also to transport the fuel. Using the larger, remote hopper enables the hopper bin to be filled by a delivery person in a manner similar to the, present LP gas tank refills. A thermostat 172 and associated control circuitry 170 provide control over power for igniter elements 130, fuel auger 140, agitator motor 158, combustion air blower fan 120, and a heated air outlet fan not illustrated, but typically adjacent room air outlet 104. Second exterior chamber wall 102 is typically provided outside of the fire chamber, forming a second enclosure through which air will pass and be circulated by a blower fan. This air, which is heated through heat exchanged from the fire chamber walls, is then passed to the point of demand. For exemplary purposes only, and not intended to be limiting, the heated air may be passed into heat ducts for distribution throughout an enclosure such as a building or the like.

Figures 5, 6:
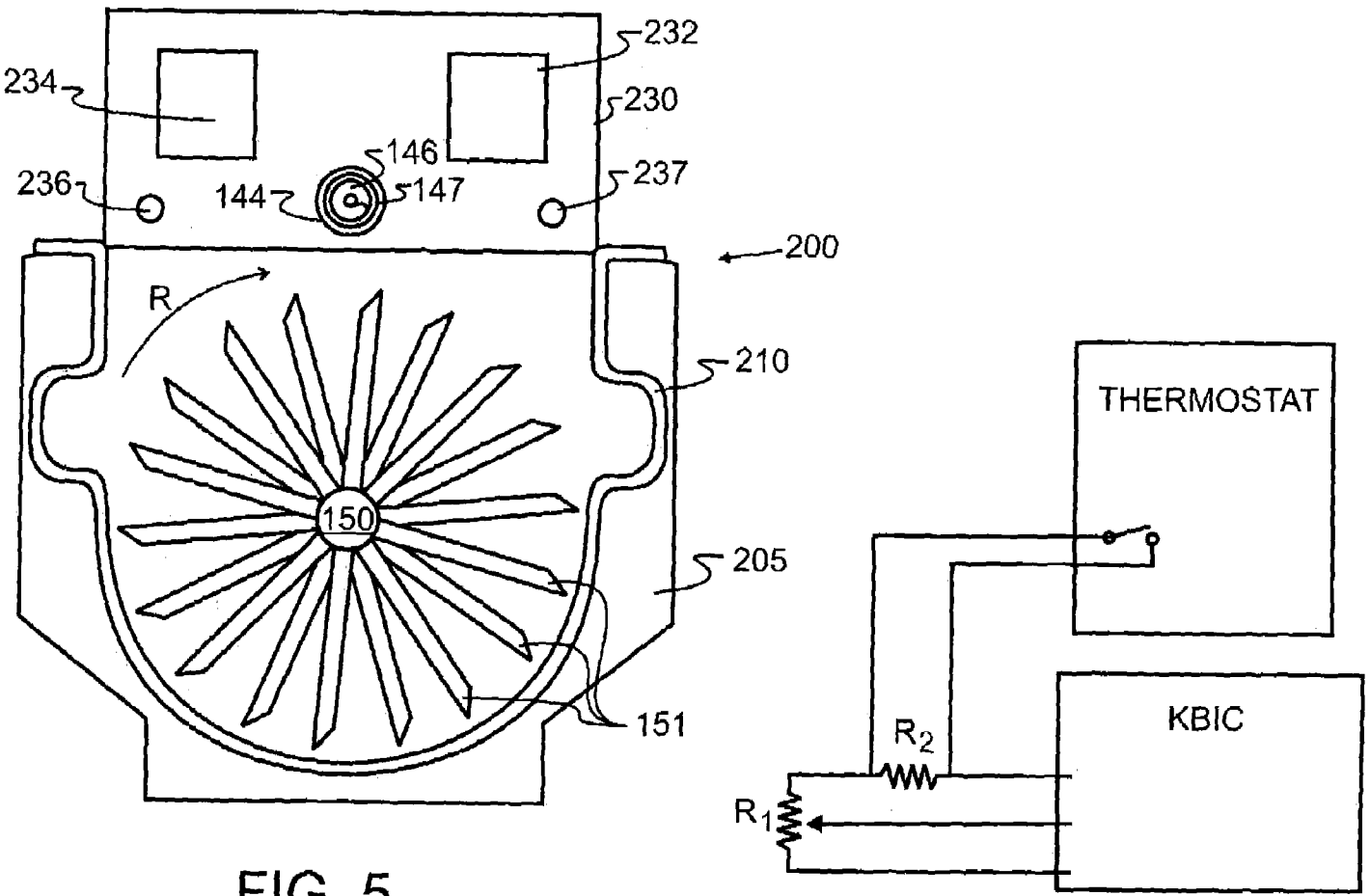
FIG. 5 illustrates a first alternative embodiment fire pot designed in accord with the teachings of the invention from end view.
FIG. 6 illustrates a preferred embodiment furnace controller designed in accord with the teachings of the invention schematically.
Figure 5A:
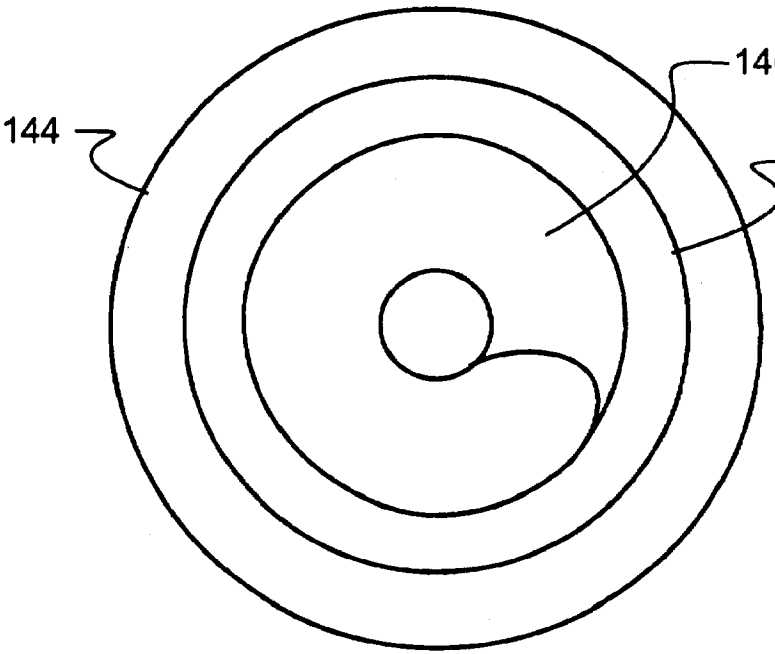
Figure 5B:
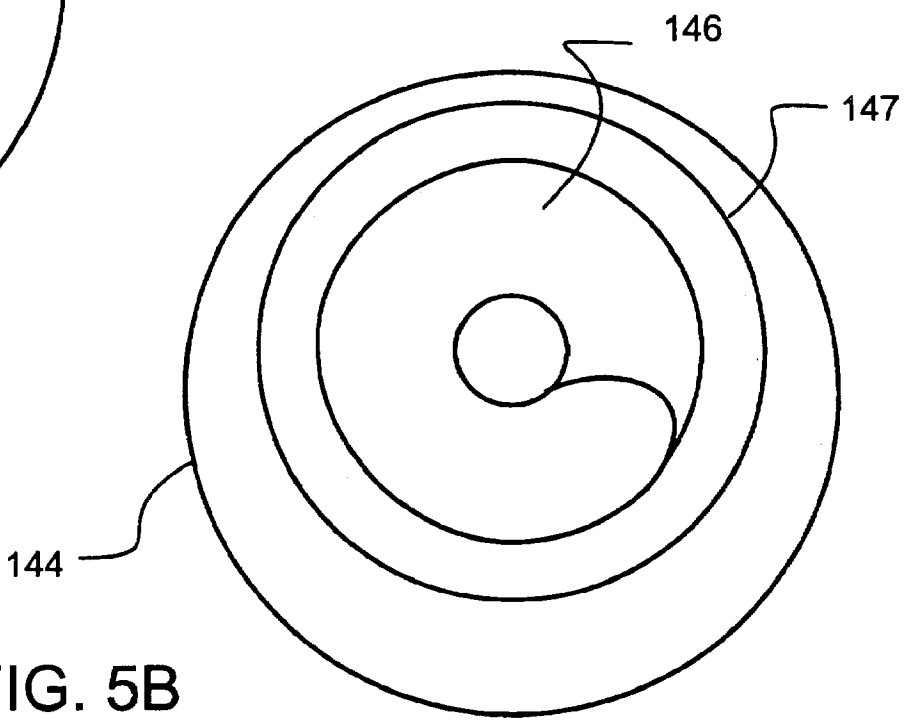
FIG. 5*b* illustrates auger and auger interior tube in an offset position with respect to auger exterior tube.

As illustrated in FIG. 1, combustion air is provided by blower 120 through main plenum 122 which most preferably extends underneath the fire pot from end to end. Most preferably prior to fire pot 200, a first branch plenum 124 directs air upwards to an access hole 152 into the core of optionally hollow agitator 150, and additionally further upward to fuel auger exterior tube 144. Most preferably, there will be sufficient airflow about or through fuel auger exterior tube 144 to ensure that the temperature within auger 140 is maintained at a level safely below the combustion point of the fuel passing through. In the illustrated and preferred embodiment of FIGS. 1 and 2, the cool inlet air will pass through auger exterior tube 144 which surrounds the auger interior tube 147. The use of two concentric tubes ensures that auger interior tube 147 is continually surrounded by relatively cool inlet air rather than the much hotter combustion chamber gases. The auger exterior tube 144 need not be concentric with the auger interior tube 147, such as illustrated in FIGS. 5 and 5*a* nor does it have to form a complete enclosure about the auger interior tube 147. As illustrated in FIG. 5*b*, auger interior tube 147 and auger exterior tube 144 may also be adjusted to offset from concentric, which will in turn cause the relatively cool inlet air to be offset with respect to auger 146. Nevertheless, in the preferred embodiment this auger exterior tube 144 does completely surround auger interior tube 147.

Figure 2:
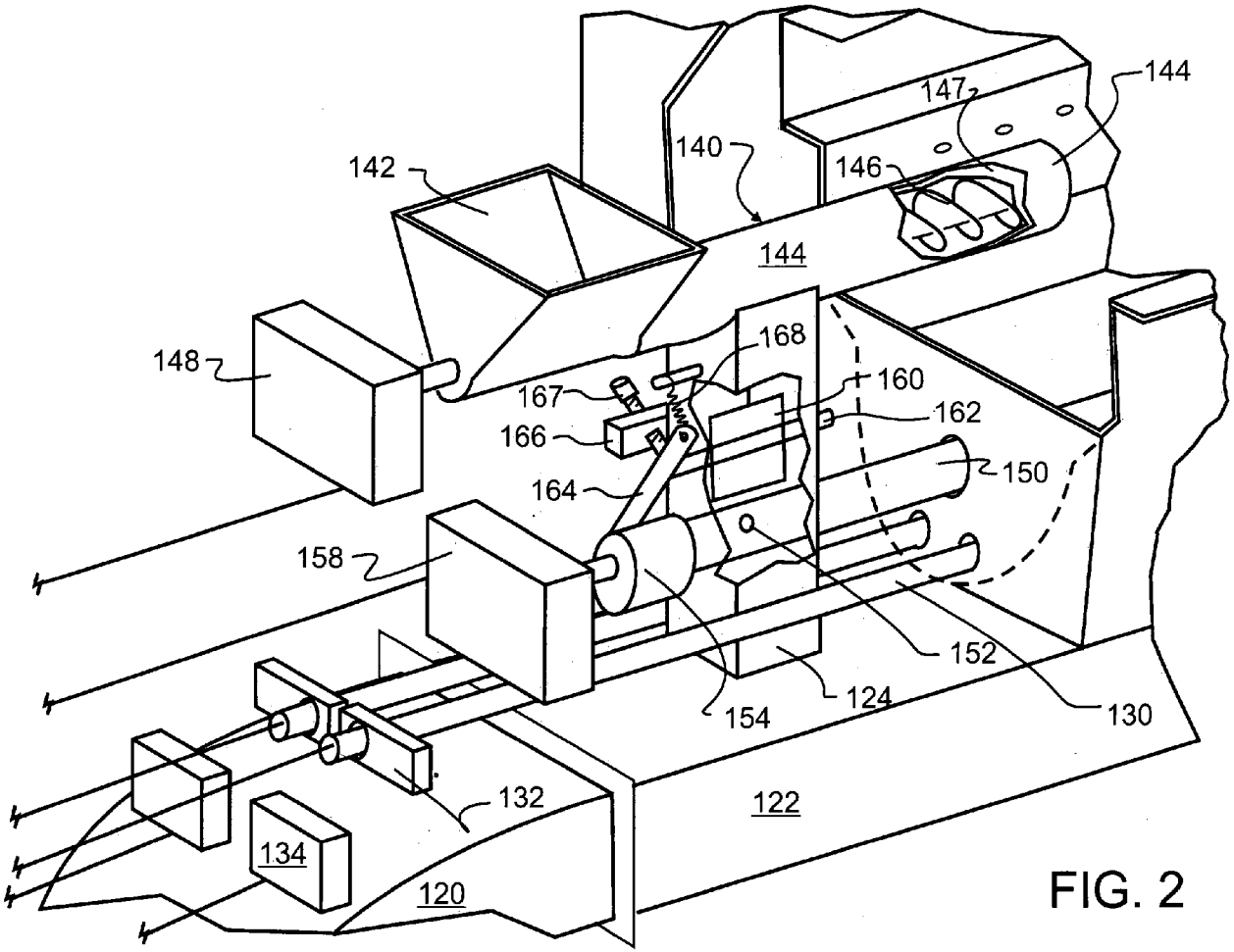
FIG. 2 provides an enlarged view of some of the components of the preferred embodiment corn furnace of FIG. 1, taken along line 2'.

The air flowing around auger interior tube 147 is most preferably controlled to distribute fuel within fire pot 200. This distribution of fuel is controlled in the preferred embodiment through the varying of a butterfly valve 160 within first branch plenum 124 leading to auger exterior tube 144. Butterfly valve 160 may be varied in the preferred embodiment of FIGS. 1 and 2 by a cam 154 mounted for rotation in association with agitator tube 150. Cam 154 will most preferably be designed to vary the air flow with position of agitator tube 150, so that when butterfly valve 160 is in an open position, kernels are carried within the inlet air to the opposite end of fire pot 200. Consequently, as butterfly valve 160 closes, kernels are dropped more closely to the auger outlet. In this way, fuel is more evenly be distributed within fire pot 200, which in turn makes optimum use of fire pot 200, thereby increasing the maximum BTU output for a given size fire pot while also helping to minimize the formation of ash and clinkers. In order to calibrate the burner for most efficient distribution of fuel using air flow through auger exterior tube 144, an adjustment screw 167 passing through fixed block 166 may be provided as shown in FIG. 2 which varies the position of butterfly valve 160 by a preset amount relative to cam 154. This calibration may be made at the factory or at a later date during servicing, inspection or the like, as will be determined appropriate for a particular burner design at the time of manufacture or installation. Adjustment screw 167 may be provided merely to set a minimum air flow through auger exterior tube 144, which is as shown in FIG. 2, or adjustment screw 167 may alternatively be designed to provide an overall offset of air flow. In other words, rotation in a first direction would increase air flow at all positions of cam 154, while rotation in a second direction opposite the first would then decrease air flow at all positions of cam 154. The specific embodiment to be implemented will be readily selected by one reasonably skilled in the art, in light of the remaining disclosure herein.

Air flow is further combined with rotation of agitator tube 150, resulting in better distribution of fuel and more complete exposure of fuel to air. In the case of corn as a fuel, kernels are spread about fire pot 200 and then stirred by agitator teeth 151 to prevent the formation of large unburned carbon structures commonly referred to in the industry as clinkers. Consequently corn is reduced by the present corn burner 100 beyond prior art corn residual to ash in the present invention, and then the ash is allowed to burn free of agitation in the last portion of the fire pot, in turn leading to more complete combustion and reduced ash residual.

In the preferred embodiment, air passing adjacent auger interior tube 147 performs another important function. During operation of corn burner 100, this air provides oxygen at the top of fire pot 200. The top of fire pot 200 is mainly filled with combustion gases, typically not fully burned. The introduction of additional oxygen into this part of the chamber may be accompanied by substantial further combustion, sufficient to form a blue flame or ring adjacent the auger outlet. The added combustion of course increases the overall efficiency of corn burner 100.

An air inlet 152 may, as aforementioned, also be provided within agitator 150 which permits the flow of cool inlet air therein, which in turn may extend the life of agitator 150. Without cooling air, agitator 150 may be prone to thermal warp. Consequently, it is desirable to circulate sufficient cooling air to prevent such warping, or to design agitator 150 from thermally resistant materials such as stainless steel or the like. As an added benefit of air passing through first branch plenum 124, agitator 151 adjacent agitator motor 158 is cool to the touch, thereby protecting agitator motor 158 and all associated bearings from any heating effect from fire pot 200.

Additional air inlets 222 are provided along the bottom of fire pot 200, passing inlet air up into fire pot 200 under the pressure of blower 120. Most preferably, the inlet pressure will be equivalent to several inches of water, which tends to prevent fuel and ash from settling over or blocking air inlets 220, 222. Air inlets 220, 222 are also preferably relatively small, to prevent the passage of fuel from fire pot 200 into main plenum 122. In the preferred embodiment, these air inlets 220, 222 are approximately one-eighth of an inch in diameter, though a designer will recognize the most appropriate size for these openings for a given application.

Solid fuel burners typically require a certain amount of pre-heating in order for the fuel to be combusted within the fire pot. While other known means of initiating combustion may be suitable for use in the present invention, the use of one or more electric heating ignitors is most preferred. Two ignitors 130 are illustrated in FIGS. 1 and 2, and as shown therein ignitors 130 are in an ignition position. As shown, ignitors 130 extend through tubes 131 that pass through fire pot 200 wall, and extend into fire pot 200. Most preferably, there is a minimum of clearance between the ignitor elements and the tubes, which when combined with corrosion, soot or the like will prevent the escape of combustion gases through these tubes 131. Seals could alternatively be provided between ignitors 130 and tubes 131, as required or when desired.

The ignitor tubes 131 could, depending upon the exact positioning, interfere with the rotation of agitator tube 150. Consequently, safety switches 134 are provided which must be closed for agitator tube 150 to be rotated. These safety switches 134 are activated by ignitor handles 132 when ignitors 130 are fully retracted from fire pot 200. Consequently, ignitors 130 may be moved from fire pot 200 by manually gasping handles 132 and sliding these into engagement with safety switches 134, at which time agitator tube 150 will be enabled by switches 134 for rotation. When control box 170 is otherwise signaled, agitator tube 150 may then be rotated.

Just as ignitors 130 are preferred to generate the initial temperatures required for combustion of solid fuel such as corn kernels, the combustion process will most preferably be controlled to maintain combustion at rates which tend to anticipate the demands for heat. Consequently, burning of fuel will be maintained continuously, and variably controlled to match the demand for heat. This virtually eliminates the need to start and stop the burner, which is relatively more difficult with solid fuel than with prior art liquid or gas fueled heaters. In order to achieve this desirable control, thermostat 172 and control box 170 are most preferably designed to variably control auger motor 148 and blower 120, thereby varying fuel and air introduced into fire pot 200, and consequently varying the heat output from the burner. Most preferably, this heat output is controlled as a function of heat demanded to maintain a given temperature, and the current deviation therefrom. For exemplary purposes, but understanding that there are other implementations that will be devised by those skilled in the art that may cooperate effectively in the preferred embodiment of FIG. 1, an electronic record may be kept of the auger motor speed and blower speed over a time period, and the direction and amount the thermostat temperature deviated over that same time period at these motor and blower speeds. New values may be relatively accurately calculated for auger motor and inlet blower to adjust the heat output of the burner, to once more target the desired thermostat temperature by taking into account the rate of deviation at the thermostat. In other words, the heat output from the burner required to maintain a given temperature is anticipated based upon rate of deviation at the current heat output. In a more simple alternative, the amount of current temperature deviation from the desired temperature may be used to determine a threshold deviation, which, when reached, may be used to vary the blower and auger from a neutral setting. This is illustrated in FIG. 6, where Thermostat is used to shunt resistor R2, thereby changing the desired setting input into KBIC, which is a solid state SCR DC motor speed control circuit such as commercially available from KB Electronics of Coral Springs, Fla. Whatever the technique used to adjust the auger and blower speeds, most preferably there will be calculated or predetermined ratios between auger motor speed and blower speed. These ratios are used to maintain proper air-to-fuel ratio within fire pot 200 at all available levels of required heat output, to thereby maintain maximum burner efficiency and combustion cleanliness.

The most preferred embodiment has a minimum of sensors, thereby reducing the technical complexity of corn burner 100 and generally improving reliability. However, additional electro-mechanical and electronic controls and sensors may be incorporated into the preferred embodiment without deviating from the teachings of the present invention provided herein. More particularly, chemical and physical sensors may be provided to monitor combustion compounds and temperatures within the fire chamber and control such factors as air or fuel introduction or distribution, or other useful parameters of operation.

Figure 3:
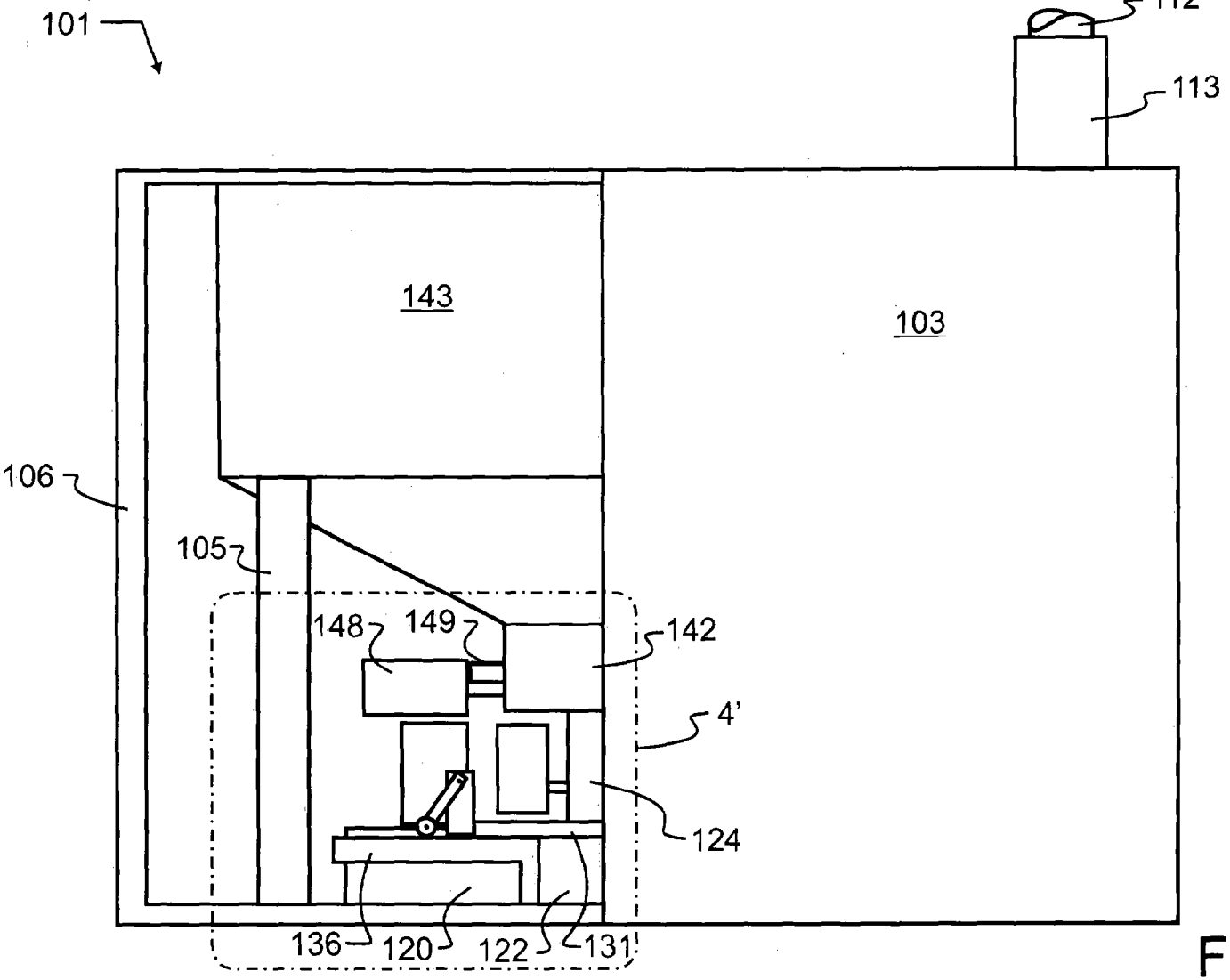
FIG. 3, illustrates a first alternative embodiment corn furnace designed in accord with the teachings of the invention from side, schematic view.
Figure 4:
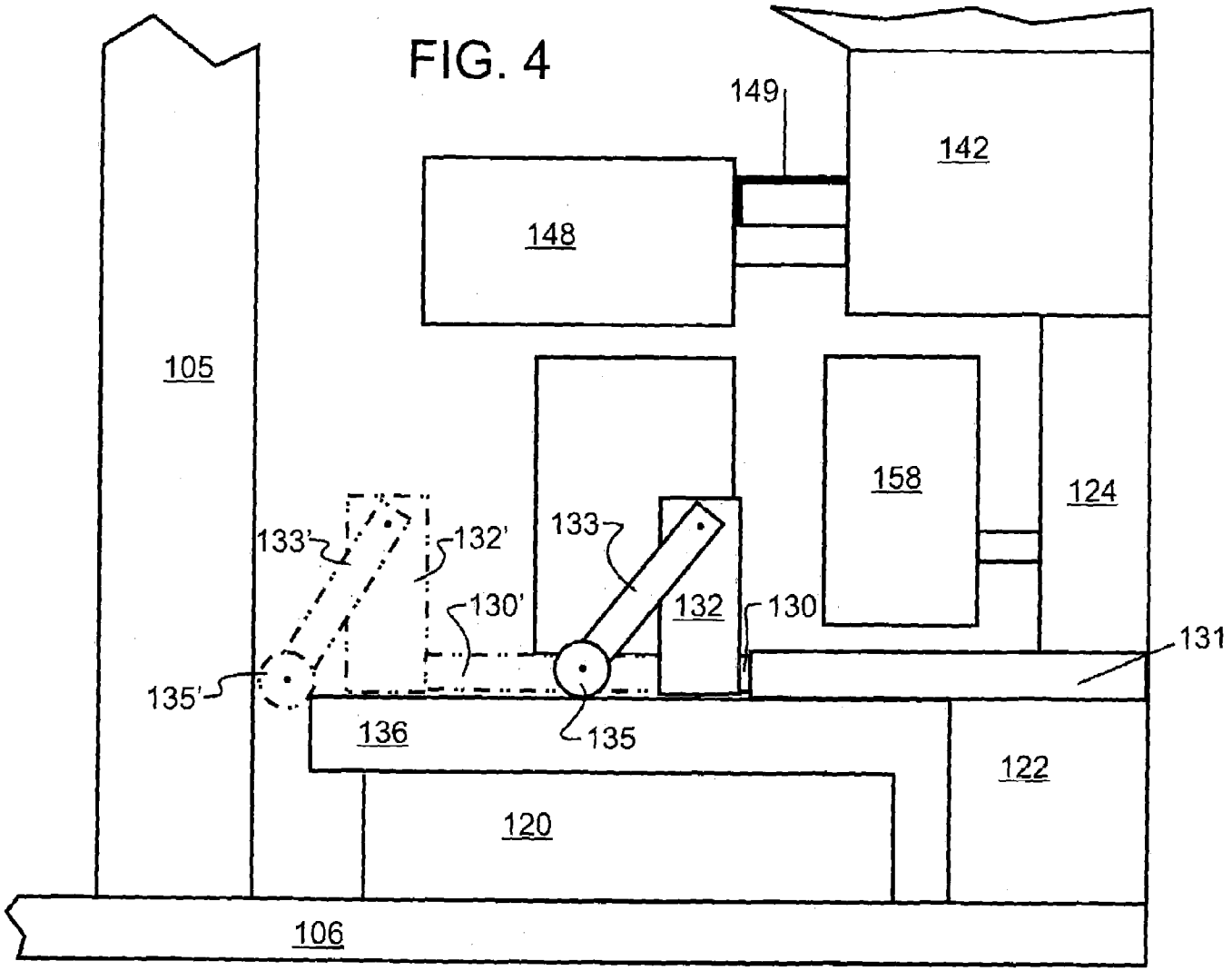
FIG. 4 provides an enlarged view of some of the components of the first alternative embodiment corn furnace of FIG. 3, taken along line 4'.

FIGS. 3 and 4 illustrate a first alternative embodiment corn burner 101 having like components numbered the same as in the preferred schematic illustration of FIGS. 1 and 2. As shown therein, a large auxiliary hopper 143 may be provided which feeds directly into hopper 142. A support post 105 may be provided to support the extra weight of corn that may be received in auxiliary hopper 143. A structural frame 106 may similarly be provided. Chamber 103 encloses fire pot 200, and in this alternative embodiment, may be used to create a water jacket thereabout. When, as in this alternative embodiment, a water jacket is created, the preferred output of thermal energy is in the form of hot water or steam as is found in many industrial or residential boilers. In order to further boost the efficiency of operation, most preferably where a corn burner such as burner 100 is used to heat air, inlet 113 may be used to preheat room air.

FIG. 4 illustrates the operation of ignitor 130, showing handle 132 in the operative and inserted position. In this position, arm 133 through roller 135 is held at an approximately eight o'clock position by riding upon bracket 136. However, when in the position illustrated by broken lines and prime number designations, arm 133' pivots somewhat counter clockwise, and may then be used to trigger a switch such as a micro-switch or the like for detection of removed position. Also visible in FIG. 4 is the bracket 149 used to support auger motor 148. Other suitable brackets or arrangements may be sued used for each of the motors used herein, and while necessary for operation, form no consequential part of the present inventive concept.

Figure 7:
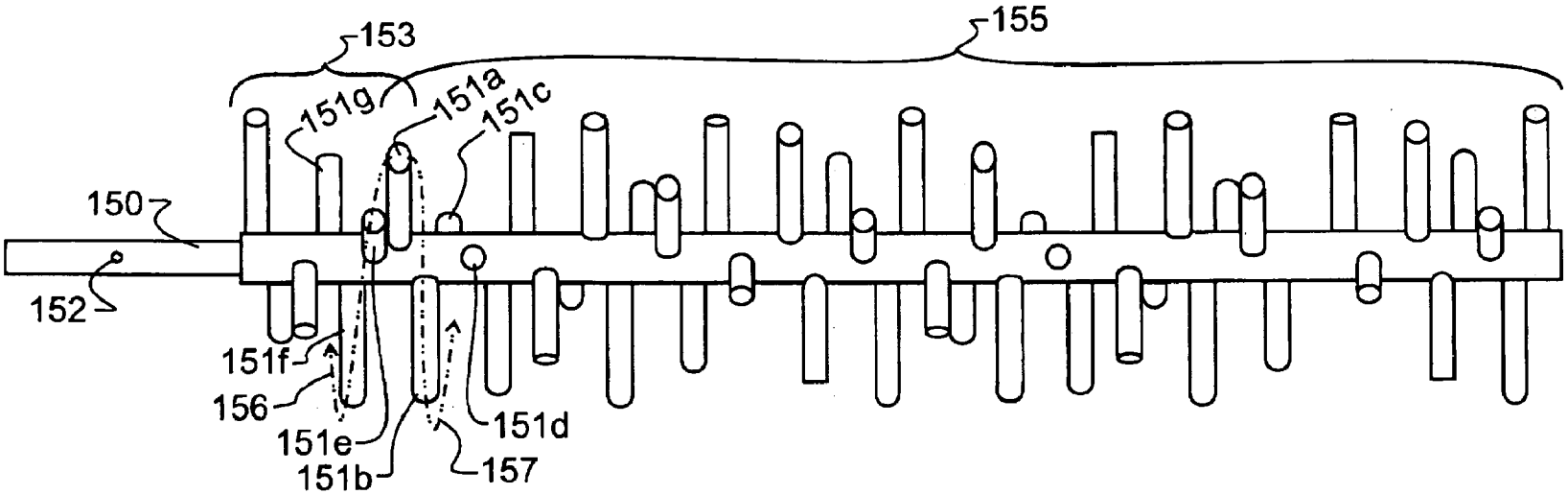
FIG. 7 illustrates the preferred auger of FIG. 1 from a side plan view.

FIG. 5 illustrates fire pot 200 from end view looking down agitator 150 central shaft, opposite fuel auger 146. A part of fire chamber wall is formed by wall 230, which has several viewing windows 232, 234 formed therein. These viewing windows will most preferably have closures provided during operation, but are available for inspection purposes, particularly when starting combustion within fire pot 200. Fire pot 200 is removable from corn burners such as burners 100, 101 through two screw or bolt holes 236, 237, though other means of attachment may be provided. As will be apparent from FIGS. 1–4, and preferably where hopper 142 is not mechanically attached to auxiliary hopper 143, all components associated with fire pot 200 will move therewith for ready inspection, repair, or cleaning. Fire pot internal wall 210 is generally U-shaped, but may preferably have two small ears formed therein just above the center line defined by agitator central shaft 150. Most preferably, these will provide improved air flow from air jacket 205 which surrounds inner wall 210. A particularly preferred double helical arrangement of agitator teeth 151 is visible in FIG. 1 and shown in more clear detail in FIG. 7, which provides most preferred movement of corn and ash to the end of the fire pot opposite the auger inlet. The helical arrangement may preferably be designed to include a few teeth 153 most nearly adjacent fuel auger 146 that serve to move fuel gradual towards this wall 230. The remaining teeth 155 will tend to move fuel away therefrom. The general direction of rotation of teeth 151 is identified by arrow R in FIG. 5. As may be understood best from FIG. 7, tooth 151 a will couple with teeth 151*b*, 151*c*, 151*d* and the remaining teeth in that direction to move corn and ash to the end of the fire pot opposite the auger inlet. Tooth 151 a couples with teeth 151*e*, 151*f*, 151*g*, and the remaining teeth in that direction to move corn towards wall 230. This opposed direction of tooth rotation may be seen from helical rotation patterns shown by lines 156 and 157, which each originate from tooth 151*a* and follow the pattern of teeth 151 that will interact with corn in two different directions of travel. By providing a few teeth that move fuel towards wall 230, a good fire will be maintained adjacent fuel auger 146, which has been determined to provide improved operation.

The spacing between teeth 151 is also important for the clinker-free operation of corn burner 100. When corn is used as the fuel source, approximately 5/32" clearance is provided between adjacent teeth 151, and also between each tooth and the inner wall 210. This clearance may, in one embodiment, be less than the smallest average cross-sectional dimension of the fuel being used.

From the foregoing figures, additional features and options become more apparent. First of all, the burner may be manufactured from a variety of materials, including ceramics, refractory metals, stainless steel, carbon steel, or other suitable materials or combinations of materials. The specific material used may vary as will be recognized by those skilled in the art of burner construction. Where metal is used for the fire chamber wall, strips may be welded or tacked on to the fire chamber that extend therefrom, to increase the amount of heat exchange surface area. These strips may further be provided with holes and thereby force the channeling of air or water, as may be desired.

A variety of designs have been contemplated for the burner, including the fire pot within the burner. The particular fire pot illustrated herein includes a generally U-shaped burner compartment, in part dictated by the generally circular reach of the most preferred agitator. However, other shapes and geometries may be used, and more than one agitator may be provided as desired. Consequently, the exact geometries or shapes of the burner compartment and fire pot are not critical to the successful operation of the invention, provided the embodiment chosen provides adequate air flow and suitable exposure of fuel to oxygen source to adequately combust the fuel. The materials used for a particular design may be chosen not only based upon the usual requirements for a burner, but may also factor in the particular design including types of fuel, chamber size, and other factors that will be recognized by the designer. Other variations are also contemplated herein and have been only illustrated by way of selected alternative embodiments.

While the foregoing details what is felt to be the preferred and additional alternative embodiments of the invention, no material limitations to the scope of the claimed invention are intended. The possible variants that would be possible from a reading of the present disclosure are too many in number for individual listings herein, though they are understood to be included in the present invention. Further, features and design alternatives that would be obvious to one of ordinary skill in the art are considered to be incorporated also.

We claim:

1. A pellet fuel burner operative to combust pellet fuel and thereby produce thermal energy, comprising:

a fire pot operative to contain said pellet fuel during combustion;

a fuel auger for introducing said pellet fuel into said fire pot; and a variable air stream circumferentially surrounding and coupled to said fuel auger and shielding said fuel auger from combustion temperatures and receiving said pellet fuel therein and transporting said pellet fuel through a distance within said fire pot which varies responsive to a variance of said variable air stream, wherein said variable air stream is adjustable to be centered with said fuel auger, or to be offset therefrom.

2. The pellet fuel burner of claim 1, wherein said air comprises adequate oxygen to support said combustion.

3. A solid fuel burner having variable energy output responsive to a variable demand, comprising:

a combustion chamber;

a means for supplying oxygen to said combustion chamber;

a means for introducing solid fuel into said combustion chamber;

a means for variably controlling at least one of said oxygen supply means and said solid fuel introducing means;

a means for detecting a threshold magnitude of said variable demand;

a means responsive to said threshold magnitude detection to cause said variable control means to vary at least one of said oxygen supply means and said solid fuel means;

an agitator having an agitator drive for moving said agitator relative to said combustion chamber;

an ignitor position detector; and an interlock responsive to said ignitor position detector disabling said agitator drive.

4. An agitated solid fuel burner comprising:

a combustion chamber having a trough shaped fire pot;

a solid fuel inlet;

an agitator longitudinally extending along a length within said combustion chamber and rotatable thereabout having a plurality of teeth extending from a central agitator axis, said teeth having longitudinal separations less than the cross-sectional dimension of an average solid fuel pellet; and a drive operatively rotating said agitator relative to said fire pot.

5. The agitated solid fuel burner of claim 4 wherein said trough-shaped fire pot further comprises a generally U-shaped cross-section.

6. The agitated solid fuel burner of claim 4 wherein said plurality of teeth create a generally helical pattern about said central agitator axis.

7. The agitated solid fuel burner of claim 4 wherein said agitator operatively moves solid fuel longitudinally across said fire pot.

8. The agitated solid fuel burner of claim 4 wherein said solid fuel burner burns corn kernels.

9. In combination, a fire pot, fuel pellets and an ignitor which produces temperatures sufficient for ignition of said fuel pellets, wherein the improvement comprises a means to manually position said ignitor between a first position operative to ignite said fuel pellets and a second position removed from interference with combustion of said fuel pellets and further comprises an agitator within said fire pot which interferes with said ignitor when said ignitor is in said first operative position and which has clearance with said ignitor when said ignitor is in said second removed position.

10. The combination fire pot, fuel pellets and ignitor of claim 9, wherein said improvement further comprises an interlock switch disabling said agitator when said ignitor is in said first operative position and enabling said agitator when said ignitor is in said second removed position.

11. The combination fire pot, fuel pellets and ignitor of claim 9, wherein said improvement further comprises at least one hand-grasping surface coupled to said ignitor.

12. A pellet fuel burner operative to combust pellet fuel and thereby produce thermal energy, comprising:

a fire pot operative to contain said pellet fuel during combustion;

an agitator operative in said fire pot and having a shaft;

a fuel auger for introducing said pellet fuel into said fire pot;

a variable gas stream coupled to said fuel auger and receiving said pellet fuel therein and transporting said pellet fuel through a distance within said fire pot which varies responsive to a variance of said variable gas stream; and a flow rate controller coupled to said agitator shaft and operating cyclically.

13. The pellet fuel burner of claim 12 wherein said flow rate controller comprises a damper.

14. A solid fuel burner having variable energy output responsive to a variable demand, comprising:

a combustion chamber;

a means for supplying oxygen to said combustion chamber;

a means for introducing solid fuel into said combustion chamber;

a means for variably controlling at least one of said oxygen supply means and said solid fuel introducing means;

a means for detecting a threshold magnitude of said variable demand comprising a temperature sensitive switch which, when activated, provides a low resistance shunt about a control resistor; and a means responsive to said threshold magnitude detection to cause said variable control means to vary at least one of said oxygen supply means and said solid fuel means.

15. An agitated solid fuel burner comprising:

a combustion chamber having a trough shaped fire pot;

a solid fuel inlet;

an agitator longitudinally extending along a length within said combustion chamber and rotatable thereabout having a plurality of teeth extending from and creating a generally helical pattern about a central agitator axis; and a drive operatively rotating said agitator relative to said fire pot;

wherein a subset of said plurality of teeth located more nearly adjacent said solid fuel inlet than a remainder of said plurality of teeth form a helical pattern of rotation in a first direction about said central agitator axis tending to urge solid fuel towards said solid fuel inlet, and said remainder of said plurality of teeth form a helical pattern of rotation in a second direction about said central agitator axis tending to urge said solid fuel away from said solid fuel inlet.

* * * * *